US011219944B2

(12) United States Patent
Lee et al.

(10) Patent No.: US 11,219,944 B2
(45) Date of Patent: Jan. 11, 2022

(54) CASTING METHOD FOR FORMING SCREW HOLE ON INCLINED PLANE OF CASTING, AND CASTING INTEGRATED WITH INSERT HAVING SCREW THREAD

(71) Applicants: Hyundai Motor Company, Seoul (KR); Kia Motors Corporation, Seoul (KR); Jinhap Bollhoff Ltd., Gyeonggi-do (KR)

(72) Inventors: Cheol-Ung Lee, Gyeonggi-do (KR); Yoon-Ki Lee, Gyeonggi-do (KR); Jin-Yong Kim, Gyeonggi-do (KR); Jae-Young An, Gangwon-do (KR); Woo-Seok Jang, Busan (KR)

(73) Assignees: Hyundai Motor Company, Seoul (KR); Kia Motors Corporation, Seoul (KR); Jinhap Bollhoff Ltd., Gyeonggi-Do (KR)

( * ) Notice: Subject to any disclaimer, the term of this patent is extended or adjusted under 35 U.S.C. 154(b) by 0 days.

(21) Appl. No.: 16/841,071

(22) Filed: Apr. 6, 2020

(65) Prior Publication Data

US 2021/0213516 A1 Jul. 15, 2021

(30) Foreign Application Priority Data

Jan. 15, 2020 (KR) ..... 10-2020-0005167

(51) Int. Cl.
*B22D 17/00* (2006.01)
*B22D 17/20* (2006.01)

(52) U.S. Cl.
CPC ..... *B22D 17/002* (2013.01); *B22D 17/2061* (2013.01)

(58) Field of Classification Search
CPC .. B22D 17/002; B22D 17/2061; B22D 19/00; B22D 19/0036; B22D 19/0054; B22D 19/0081; B22D 19/009; B22D 19/02; B22D 19/04; B22D 19/16
See application file for complete search history.

(56) References Cited

FOREIGN PATENT DOCUMENTS

KR 2019-0094752 A 8/2019

*Primary Examiner* — Kevin P Kerns
*Assistant Examiner* — Steven S Ha
(74) *Attorney, Agent, or Firm* — Mintz Levin Cohn Ferris Glovsky and Popeo, P.C.; Peter F. Corless

(57) ABSTRACT

A casting method for forming a fastening part on an inclined plane of a casting may include mounting a plug unit including a casting plug and a screw thread insert combined with the casting plug on a movable mold or a fixed mold; performing casting by moving and combining the movable mold with the fixed mold and injecting a molten metal into a cavity formed between the movable mold and the fixed mold; performing mold opening after the casting; and separating the casting plug from the screw thread insert, wherein when the plug unit is mounted on the mold, the screw thread insert is deployed in the cavity, and a mold plane on which the casting plug is mounted forms an inclined plane having an acute angle against a horizontal plane that is parallel to a movement direction of the movable mold.

7 Claims, 7 Drawing Sheets

CASTING METHOD FOR FORMING SCREW HOLE ON INCLINED PLANE OF CASTING, AND CASTING INTEGRATED WITH INSERT HAVING SCREW THREAD

CROSS-REFERENCE TO RELATED APPLICATION(S)

This application claims under 35 U.S.C. § 119(a) the benefit of Korean Patent Application No. 10-2020-0005167, filed on Jan. 15, 2020, the entire contents of which are incorporated herein by reference.

BACKGROUND

(a) Technical Field

Exemplary embodiments of the present disclosure relate to a casting method for forming a fastening part on a casting, more particularly, to the casting method for forming a fastening hole on an inclined plane of the casting and a casting integrated with a screw thread insert.

(b) Description of the Related Art

In the case of vehicle chassis components, a characteristic of being lightweight, which may be achieved by changing steel components to aluminum or by weight loss of existing aluminum components, is important, but durability is critically necessary. In particular, in order to improve durability of a fastening part, a method for inserting separate female screw thread hardware into an existing aluminum component has been developed. In the related art, a tapping nut 1 for compulsorily pressing a female screw nut as shown in FIG. 1 or a screw thread shape 2 as shown in FIG. 2 are processed and formed on an aluminum component, and then coil-shaped female screw hardware 3 is inserted into the processed aluminum component.

The related art as described above has problems in that a process for screw tap processing or separate hardware mount should be added after the product is casted, and thus interface bonding performance between hardware and an aluminum mother material is degraded to lower a fastening force. Further, the related art has the problem of weight increase due to the separate hardware.

Accordingly, in order to minimize the weight increase and to make the interface bonding with aluminum superior without requiring a separate pressing process, there is a casting method for applying and mounting a plug for connecting a mold and hardware with each other on the mold. However, according to such a plug applying method, the plug should be mounted only in a direction that is horizontal to the direction in which the mold is opened or closed, and thus the product mold design is greatly restricted.

The foregoing description of the background technology is intended merely to help the understanding of the background of the present disclosure, and is not intended to mean that the present disclosure falls within the purview of the related art that is already known to those of ordinary skill in the art.

SUMMARY

Exemplary embodiments of the present disclosure overcome the above disadvantages and other disadvantages not described above, and an object of the present disclosure is to provide a casting method capable of mounting a plug for inserting a screw thread insert into a casting even on the casting having an inclined plane formed thereon, and the casting integrated with a screw thread insert.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In one aspect of the present disclosure, a casting method for forming a fastening part on an inclined plane of a casting includes mounting a plug unit including a casting plug and a screw thread insert combined with the casting plug on a movable mold or a fixed mold; performing casting by moving and combining the movable mold with the fixed mold and injecting a molten metal into a cavity formed between the movable mold and the fixed mold; performing mold opening after the casting; and separating the casting plug from the screw thread insert, wherein when the plug unit is mounted on the mold, the screw thread insert is deployed in the cavity, and a mold plane on which the casting plug is mounted forms an inclined plane having an acute angle against a horizontal plane that is parallel to a movement direction of the movable mold.

Further, the screw thread insert is integrally combined with the casting.

Here, the casting plug includes a truncated cone shaped plug body part; and a plug screw part projecting from a bottom plane of the plug body part and having male screw threads formed thereon, wherein the screw thread insert has female screw threads formed thereon corresponding to the male screw threads of the plug screw part, and the screw thread insert is combined with the plug screw part.

In particular, an angle of a side plane of the plug body part based on a height direction of the plug body part is greater than or equal to 30°.

Further, the angle of the side plane of the plug body part based on the height direction of the plug body part is in a range of 30° to 35°.

Further, the angle of the side plane of the plug body part based on the height direction of the plug body part is greater than or equal to 90°−(the acute angle of the inclined plane)°.

Further, the angle of the side plane of the plug body part based on the height direction of the plug body part is in a range of 90°−(an acute angle of the inclined plane)° to 90°−(an acute angle of the inclined plane)°+5°.

In another aspect of the present disclosure, a casting in which a fastening part is vertically formed on an inclined plane of the casting based on a movement direction of a mold, and a screw thread insert is integrally combined with the fastening part is provided.

According to the present disclosure, it is possible to perform the casting by forming a screw thread combination hole even on the inclined plane of the casting through application of the developed plug unit. Accordingly, a separate pressing process is not required, the interface bonding between the screw thread insert and the casting is superior, and the weight increase can be minimized as compared with the existing casting.

Further, the boss part size can be reduced, and thus casting defects can be reduced or eliminated.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The above-described objects, features, and advantages of the present disclosure will be described in detail with reference to the accompanying drawings, and accordingly, those of ordinary skill in the art to which the present disclosure pertains will be able to fully understand and easily embody the technical concept of the present disclosure.

Figure 1:
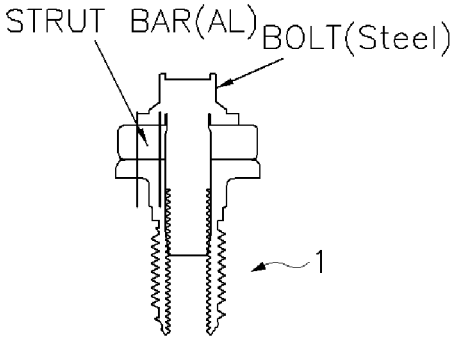
FIG.1 PRIOR ART
FIGS. 1 and 2 (RELATED ART) illustrate an example in which a fastening part is formed on a casting in the related art.
Figure 2:
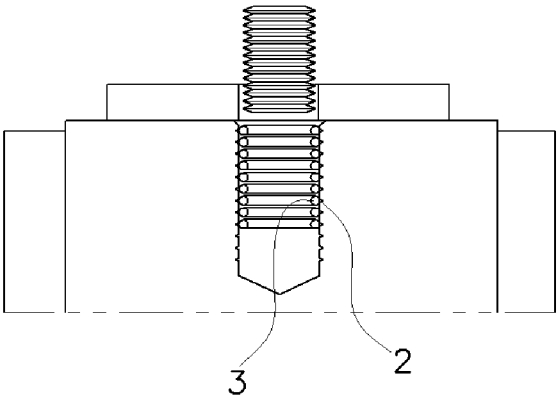
FIG.2 PRIOR ART
Figure 3:
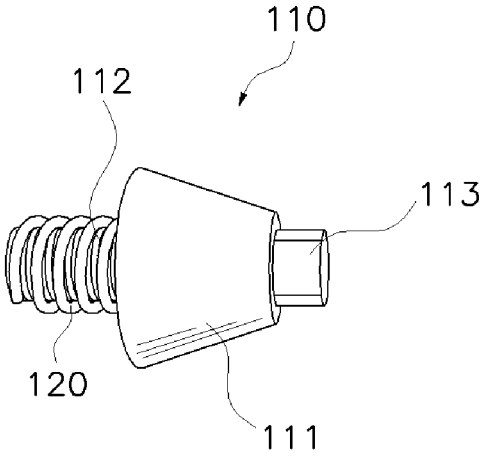
FIG. 3 illustrates a plug unit according to the present disclosure.
Figure 4A:
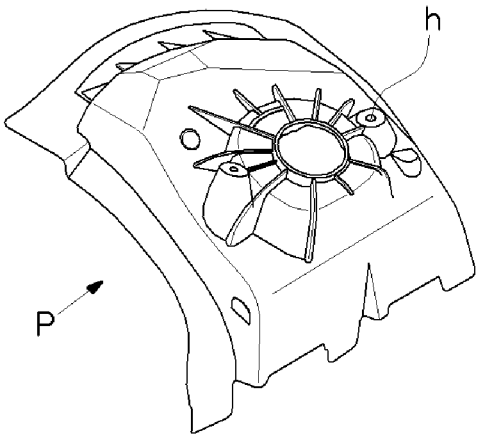
FIGS. 4A and 4B illustrate an example of a casting in which a fastening part is formed on an inclined plane.
Figure 4B:
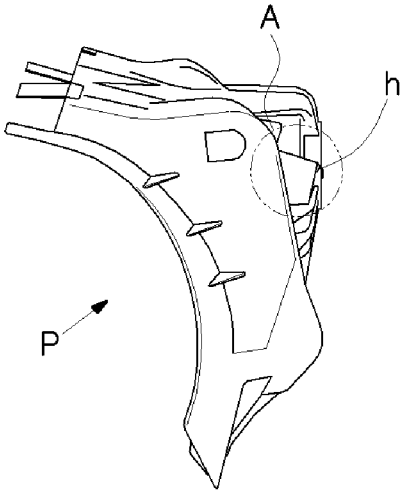
Figure 5:
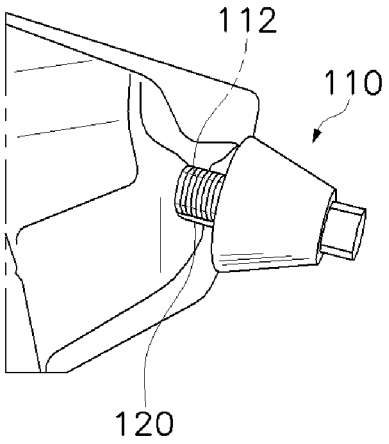
FIG. 5 illustrates a state where a plug unit is mounted on a fastening part of FIGS. 4A and 4B.
Figure 6A:
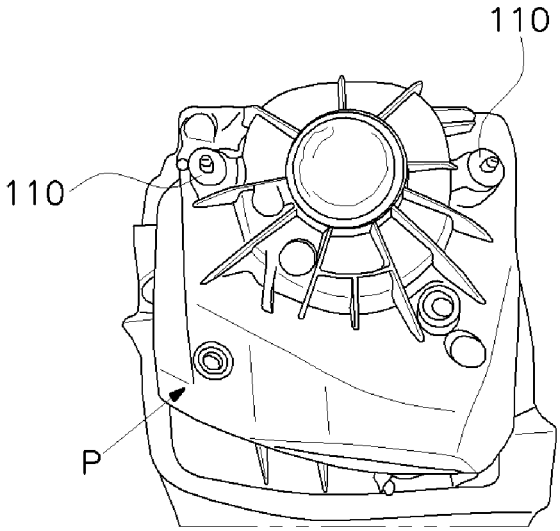
FIG. 6A illustrates a state before a plug unit is removed after casting.
Figure 6B:
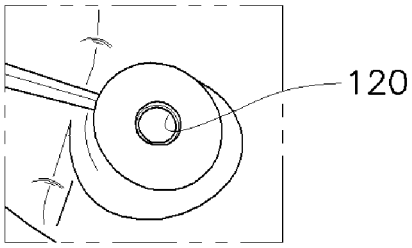
FIG. 6B illustrates a state in which a casting plug of a plug unit is removed after casting.

FIG. 3 illustrates a plug unit according to the present disclosure. FIGS. 4A and 4B illustrate an example of a casting in which a fastening part is formed on an inclined plane, and FIG. 5 illustrates a state where a plug unit is mounted on a fastening part of FIGS. 4A and 4B. FIG. 6A illustrates a state before a plug unit is removed after casting, and FIG. 6B illustrates a state in which a casting plug of a plug unit is removed after casting.

Hereinafter, with reference to FIGS. 3 to 6B, a casting method for forming a fastening part on an inclined plane of a casting and a casting integrated with a screw thread insert according to an embodiment of the present disclosure will be described.

The present disclosure is provided so as to cast a casting (casted product) in which a fastening part is formed on an inclined plane of the casting. In order to form the fastening part on the inclined plane, the casting is performed using a plug unit 100, and thus it is possible to manufacture the casting in which a screw thread insert is integrally casted with the fastening part.

First, with reference to FIG. 3, the plug unit 100 is prepared in a manner that a casting plug 110 and a screw thread insert 120 are manufactured and then are combined with each other.

The casting plug 110 includes a truncated cone shaped plug body part 111, a plug screw part 112 projecting from a bottom plane of the plug body part 111 and having male screw threads formed thereon, and a planar multi-angle shaped plug head part 113 projecting from an upper plane of the plug body part 111.

The screw thread insert 120 is a member on which female screw threads are formed corresponding to the male screw threads of the plug screw part 112.

According to the casting method of the present disclosure, the fastening part is formed on the inclined plane of the casting P to be casted with reference to FIGS. 4A and 4B.

The fastening part may be a fastening hole h, and as can be seen from FIG. 4B and FIG. 5 illustrating portion A of FIG. 4B in an enlarged manner, the fastening hole h is formed on the inclined plane.

With reference to FIG. 5, the inclined plane means a slanting plane having an acute angle against a horizontal plane that is parallel to a movement direction for combination of a movable mold and a fixed mold with each other.

As shown in FIG. 5, the movable mold and the fixed mold are deployed on left and right sides, and the casting p is casted in the shape of a cavity formed through the combination of the movable and fixed molds.

Accordingly, a mold plane corresponding to the fastening hole h is also formed as an inclined plane, and in this case, the portion of the casting plug 110 of the plug unit 100 is inserted into the mold to form the mold plane corresponding to the fastening hole h.

Further, the screw thread insert 120 is inserted into the cavity and is integrally combined with the casting P to be casted.

As described above, because the inclined plane of the plug unit 100 mounted on the inclined plane of the mold forms an acute angle against the horizontal plane, the plug unit can be stably mounted to make the integrated casting possible.

In the case of opening the mold after the casting, as shown in FIG. 6A, the plug unit 100 that is combined with the casting P is separated from the mold, and if the casting plug 110 of the plug unit 100 is separated from the screw thread insert 120, the screw thread insert 120 is integrally formed in the fastening hole of the casting P as shown in FIG. 6B.

As described above, in the case of performing the casting using the plug unit, the screw thread insert is inserted and integrally casted at high pressure, and thus post-process problems are originally solved. Further, only minimal hardware is used to form the screw threads on the casting, and thus the weight increase is minimized. Further, in the casting process, an aluminum mother material is closely combined with the hardware, and thus the interface bonding performance becomes prominent.

However, there may be limitations in mounting the hardware insert on the mold.

Figure 7A:
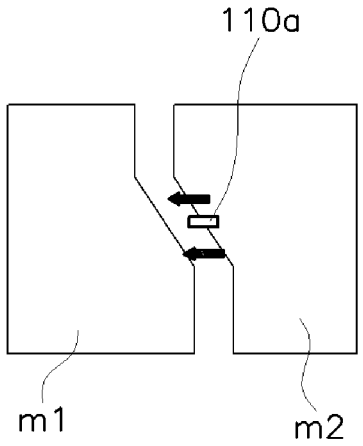
FIG.7A PRIOR ART
FIG. 7A illustrates a plug application example in the related art.
Figure 7B:
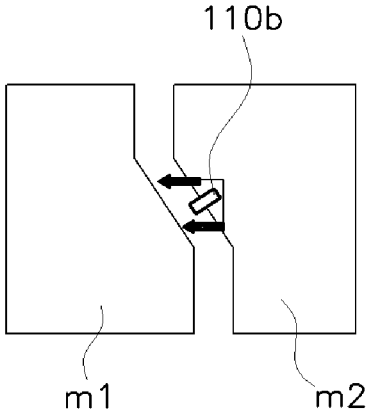
FIG.7B PRIOR ART
FIG. 7B illustrates an example in which a plug is applied to an inclined plane in the related art.

That is, if the length direction of the plug 110*a* being inserted as shown in FIG. 7A is in parallel to the horizontal plane, it is possible to open the combined molds m1 and m2. However, if the plug 110*b* is formed in an inclined direction with respect to the horizontal plane as shown in FIG. 7B, it is not possible to open the combined molds by the plug 110*b*.

As a result, the plug should be mounted only in the direction that is parallel to the direction in which the molds m1 and m2 are opened and closed, and thus the mold design is restricted.

According to the present disclosure, even in the case where the fastening part is formed on the inclined plane of the casting, the casting becomes possible through inserting of the plug unit.

Figure 8:
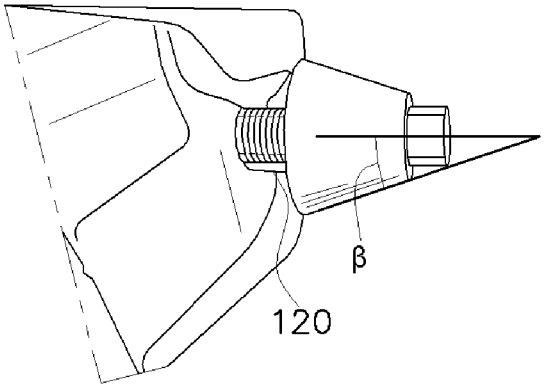
FIG. 8 is a diagram explaining a plug unit according to the present disclosure.

That is, as shown in FIG. 8, the plug body part 111 of the casting plug 110 has a truncated cone shape, and by setting an angle β of one side plane based on the height direction of the truncated cone shaped plug body part 111, it is possible to perform the casting in a state where the plug unit 100 is mounted on the mold, and even in the case of the mold opening, it is possible to open the mold without hindering the plug unit 100.

Figure 9A:
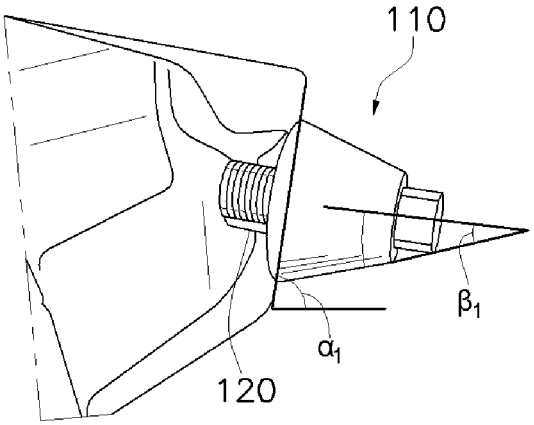
FIGS. 9A, 9B, and 9C illustrate the relationship between a plug unit and an inclined plane of a casting according to the present disclosure.
Figure 9B:
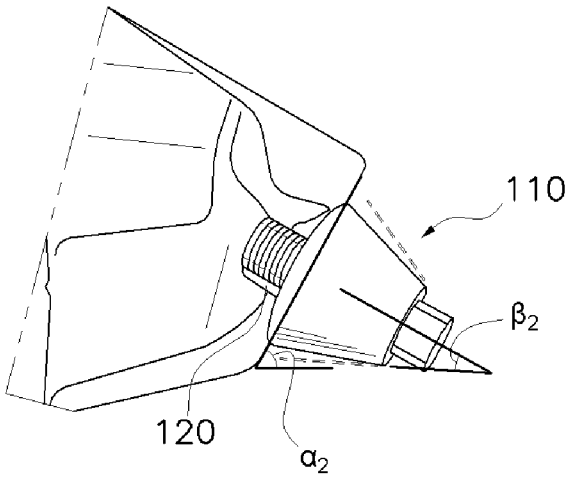
Figure 9C:
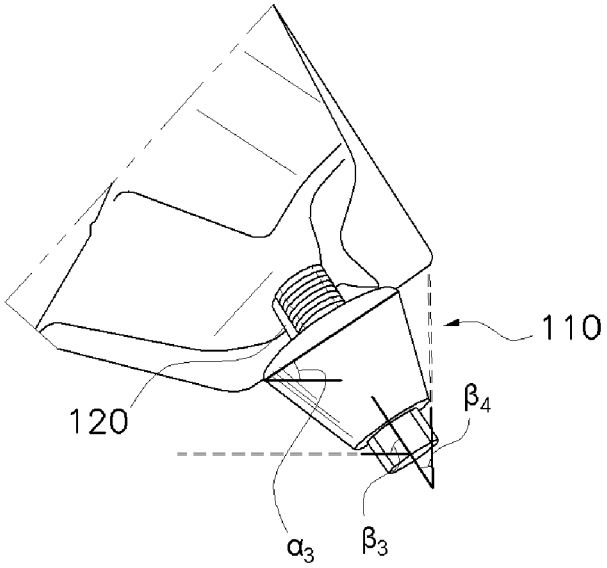

FIGS. 9A, 9B, and 9C illustrate angles of side planes of a plug body part 111 according to angles of α1, α2, and α3.

In particular, first, if an angle of the inclined plane α1 against the horizontal plane that is parallel to the movement direction of the mold as shown in FIG. 9A is greater than or equal to 60° and is less than or equal to 90°, it is preferable that an angle β1 of one side plane based on the height direction of the plug body part 111 is set to be greater than or equal to 30°, and more preferably, the angle β1 may be in the range of 30° to 35°.

That is, the angle β1 may be greater than or equal to 90°−(α1)°, and in order to facilitate the assembly of the plug unit 100 in size and shape, it may be preferable that the angle β1 is in the above-described range.

Accordingly, if the angle β1 is smaller than 30°, the mold opening may be hindered, and if the angle β1 exceeds 35°, the mold opening is not hindered, but the volume of the plug body part 111 may be unnecessarily large.

Next, if the angle of the inclined plane α2 is greater than or equal to 45° and is less than or equal to 60° as shown in FIG. 9B, the angle β2 of the side plane of the plug body part 111 is set to be greater than or equal to 90°−(α2)°.

More preferably, the angle β2 may be in the range of 90°−(α2)° to 90°−(α2)°+5°.

If the angle β2 is smaller than 90°−(α2)°, the mold opening may be hindered, and if the angle β2 exceeds 90°−(α2)°+5°, the mold opening is not hindered, but the volume of the plug body part 111 may be unnecessarily large.

Next, if the angle of the inclined plane α3 is smaller than 45° as shown in FIG. 9C, the angle β3 of the side plane of the plug body part 111 is set to be greater than or equal to 90°−(α3)°.

More preferably, the angle β3 may be in the range of 90°−(α3)° to 90°−(α3)°+5°.

If the angle β3 is smaller than 90°−(α3)°, the mold opening may be hindered, and if the angle β3 exceeds 90°−(α3)°+5°, the mold opening is not hindered, but the volume of the plug body part 111 may be unnecessarily large.

Meanwhile, if the angle of the inclined plane α3 is smaller than 45° as shown in FIG. 9C, the truncated cone shape of the plug body part 111 may be asymmetric.

That is, both bodies of the plug body part 111, being divided into two based on the plane which crosses the horizontal plane being in parallel to the movement direction of the mold and on which a vertical line that is at right angles to the cross line is a segment in the length direction of the plug screw part 112, may be asymmetric to each other. For convenience, the both bodies may be discriminated as an upper body and a lower body.

Accordingly, the both bodies of the plug body part 111 being divided into two by the above basis may be asymmetric, and may have different volumes, and thus it is not necessary that the angle β4 of the side plane of the body having the smaller volume is greater than or equal to 90°−(α3)°.

As a result, even if the angle is not greater than or equal to 90°−(α3)°, the mold opening is not hindered, and thus the angle β4 of the side plane of the upper body having the smaller volume may be in the range of (α3)° to (α3+5)°.

On the other hand, in the example of FIG. 9C in which the inclined plane of the product forms an acute angle against the horizontal plane that is parallel to the mold movement direction, the upper body may have the smaller volume, whereas in the case where the inclined plane of the product forms an obtuse angle against the horizontal plane that is parallel to the mold movement direction, the lower body may have the smaller volume.

As described above, if the plug unit is not hindered during the product mold opening, the truncated cone shape of the plug unit may have an asymmetric structure, and in this case, one of the divided bodies may be formed to have a smaller volume than that of the other of the divided bodies.

However, in the case of a symmetric structure, there is no directivity when being assembled in the mold, and thus the symmetric structure may be advantageous to the assembly.

As described above, the durability of the plug unit 100 mounted on the mold can be secured within the angle range of the side plane of the plug body part 111, and the force acting on the plug unit 100 during the casting can be minimized. Further, the mold opening is not hindered.

Further, in order to maintain the bonding force with the screw thread insert 120, it may be preferable that the height of the plug body part 111 is set to be equal to the length of the plug screw part 112 or the screw thread insert 120.

While the present disclosure has been described with reference to the exemplified drawings, it will be apparent to those of ordinary skill in the art that the present disclosure is not limited to the described embodiments, and various changes and modifications may be made without departing from the spirit and scope of the present disclosure. Accordingly, such changes and modifications should belong to the claims of the present disclosure, and the right of the present disclosure should be construed based on the appended claims.

What is claimed is:

1. A casting method for forming a fastening part on an inclined plane of a casting, comprising:

mounting a plug unit including a casting plug and a screw thread insert combined with the casting plug on a movable mold or a fixed mold;

performing casting by moving and combining the movable mold with the fixed mold and injecting a molten metal into a cavity formed between the movable mold and the fixed mold;

performing mold opening after the casting; and separating the casting plug from the screw thread insert, wherein when the plug unit is mounted on the mold, the screw thread insert is deployed in the cavity, and a mold plane on which the casting plug is mounted forms an inclined plane having an acute angle against a horizontal plane that is parallel to a movement direction of the movable mold.

2. The casting method of claim 1, wherein the screw thread insert is integrally combined with the casting.

3. The casting method of claim 1, wherein the casting plug comprises:

a truncated cone shaped plug body part; and a plug screw part projecting from a bottom plane of the plug body part and having male screw threads formed thereon, wherein the screw thread insert has female screw threads formed thereon corresponding to the male screw threads of the plug screw part, and the screw thread insert is combined with the plug screw part.

4. The casting method of claim 3, wherein an angle of a side plane of the plug body part based on a height direction of the plug body part is greater than or equal to 30°.

5. The casting method of claim 4, wherein the angle of the side plane of the plug body part based on the height direction of the plug body part is in a range of 30° to 35°.

6. The casting method of claim 3, wherein an angle of a side plane of the plug body part based on a height direction of the plug body part is greater than or equal to: 90°−(the acute angle of the inclined plane)°.

7. The casting method of claim 6, wherein the angle of the side plane of the plug body part based on the height direction of the plug body part is in a range of 90°−(the acute angle of the inclined plane)° to 90°−(the acute angle of the inclined plane)°+5°.

* * * * *